US005300014A

United States Patent [19]

Chin et al.

[11] Patent Number: 5,300,014

[45] Date of Patent: Apr. 5, 1994

[54] UNDERFLOW CONTROL FOR NOZZLE CENTRIFUGES

[75] Inventors: Milton Chin, Trumbull; Chie-Ying Lee, Milford, both of Conn.; Robert D. Mensinger, Freeland, Pa.

[73] Assignee: Dorr-Oliver Corporation, Milford, Conn.

[21] Appl. No.: 962,380

[22] Filed: Oct. 16, 1992

[51] Int. Cl.[5] ..... B04B 7/00

[52] U.S. Cl. ..... 494/35; 494/37

[58] Field of Search ..... 494/1, 2, 3, 4, 10, 494/37, 35, 42; 210/196, 197

[56] References Cited

U.S. PATENT DOCUMENTS

| | | | |
|---|---|---|---|
| 1,847,751 | 3/1932 | Coe | 494/35 |
| 2,532,792 | 12/1950 | Svensjö494 | 35/ |
| 2,628,021 | 2/1953 | Staaff | 494/35 |
| 3,255,958 | 6/1966 | Simon | 494/35 |
| 3,623,657 | 11/1971 | Trump | 494/35 |
| 3,967,777 | 7/1976 | Canevari | 494/35 |
| 4,067,494 | 1/1978 | Willus et al. | 494/35 |
| 4,305,817 | 12/1981 | Kohlstette | 494/3 |
| 4,430,071 | 2/1984 | Willus et al. | 494/38 |
| 4,505,697 | 3/1985 | Lee et al. | 494/35 |
| 4,571,302 | 2/1986 | Willson | 210/196 |
| 4,636,308 | 1/1987 | Summers | 210/196 |
| 4,643,709 | 2/1987 | Lee et al. | 494/37 |
| 4,710,160 | 12/1987 | Klinstenstedt et al. | 494/64 |
| 4,729,759 | 3/1988 | Krook et al. | 494/4 |
| 4,759,744 | 7/1988 | Krook | 494/35 |
| 4,761,157 | 8/1988 | Shapiro | 494/35 |
| 4,816,152 | 3/1989 | Kalleberg | 210/360.2 |
| 4,820,256 | 4/1989 | Nordstrom | 494/3 |
| 4,824,431 | 4/1989 | McAlister | 494/43 |
| 4,840,612 | 6/1989 | Pallmar | 494/2 |

*Primary Examiner*—Harvey C. Hornsby
*Assistant Examiner*—Reginald L. Alexander
*Attorney, Agent, or Firm*—DeLio & Peterson

[57] ABSTRACT

In a centrifuge for the separation of solids from liquid in which concentrated solids are discharged from radial nozzles at the periphery, there is provided an concentrated solids underflow discharge control apparatus which senses an increased concentration of solids in the underflow and adjusts the flow of the recycle stream as a result thereof to prevent solids from spilling over into the effluent overflow. A sensing chamber and a control module having a flow interference device is utilized to measure a set level backup. Any alteration of said level is detected by a level sensor which sends a signal to a level indicator control and in turn controls the opening and closing of a recycle line valve which controls underflow.

24 Claims, 6 Drawing Sheets

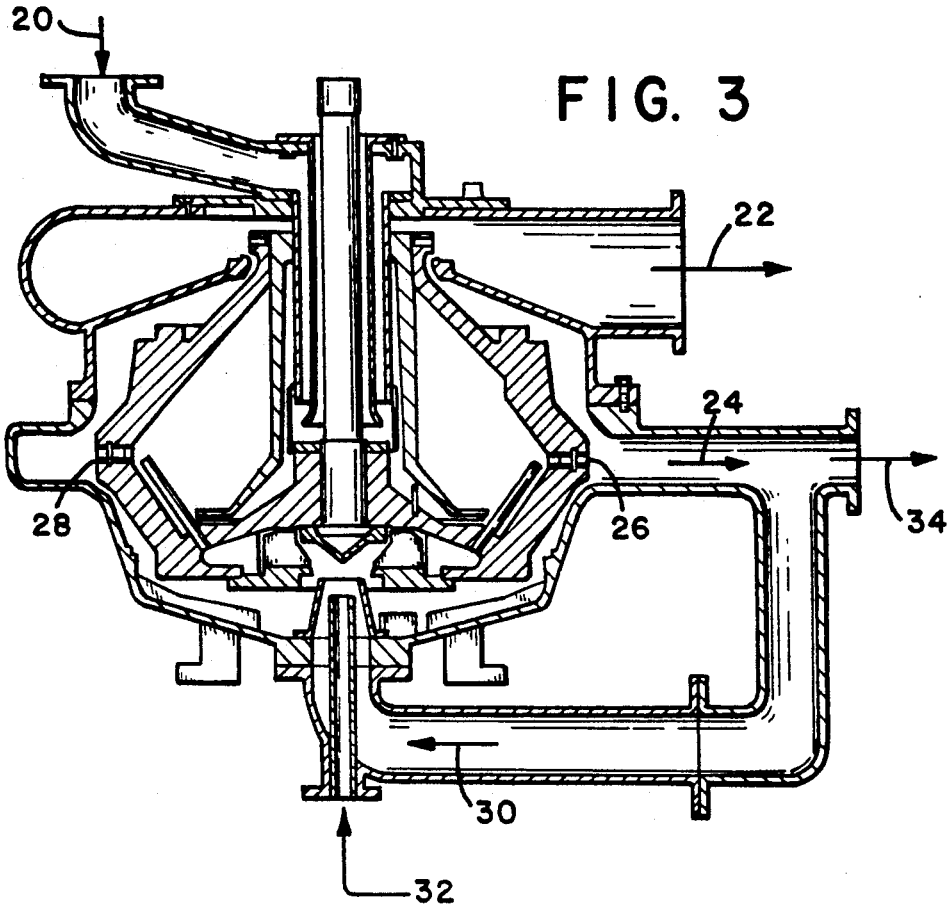
FIG. 3
FIG. 4
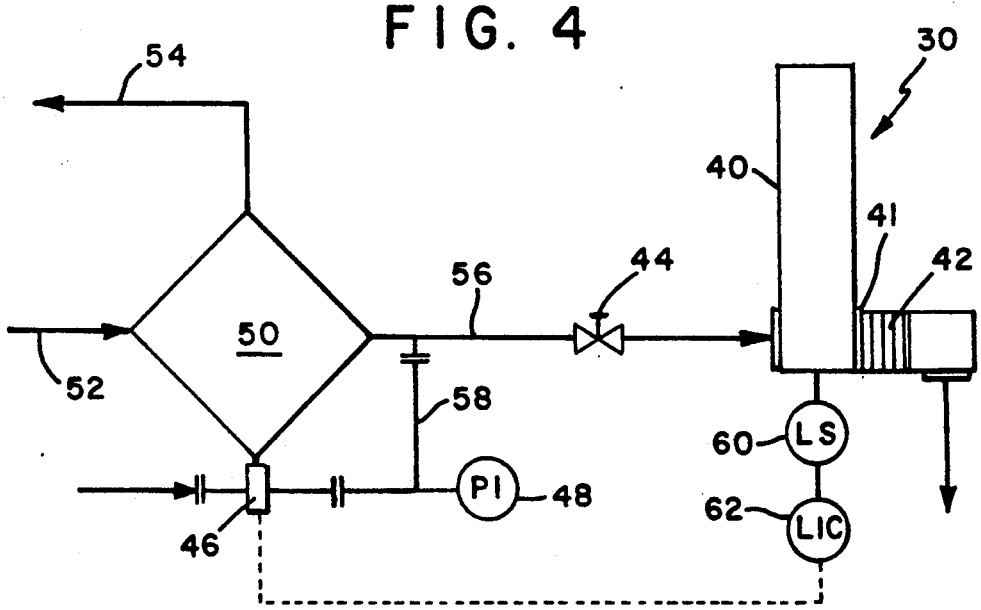

UNDERFLOW CONTROL FOR NOZZLE CENTRIFUGES

This invention relates to centrifugal separation machines of the disk-nozzle type having an overflow effluent and an underflow concentrated solids flow stream. More particularly, the invention relates to a novel method and apparatus for controlling the desired level of solids in the liquid effluent overflow by regulating the recycle line of the underflow.

BACKGROUND OF THE INVENTION

In nozzle-type centrifugal separators, known as disk-nozzle centrifuges, the separated underflow is discharged through nozzle means arranged at the outer periphery of the separating chamber in the centrifugal bowl. The centrifuge effects a two-fraction separation of a feed slurry into a heavy nozzle discharge slurry or the so-called underflow fraction or concentrate delivered by the nozzles, and a light fraction or separated liquid delivered from the overflow bowl at the top end of a machine. It is the liquid overflow which is the desired end product and must have its solids content carefully regulated. Part of the underflow fraction is recycled to the separating chamber at a controllable rate, by introduction through the lower end of the rotor bowl. In use of such separators it is often necessary to control the solids content of the discharging underflow by such recycling to the separating chamber. The common use of underflow recycling is in cases where the feed to the centrifuge has a low content of solids, and the desired result is a high concentration of solids in the underflow slurry. There is a need for precise control in these cases when the feed to the centrifuge is altered or when the underflow contains too high a concentration of solids so as to cause plugging of the discharge nozzles.

One solution to the problem was put forth by the underflow concentration control for nozzle centrifuges disclosed in U.S. Pat. No. 4,505,697, issued to Lee et al in 1985. The prior system utilizes means for regulating the quantity of recycle in response to an increase in the viscosity of the underflow. More particularly, the underflow containing a given concentration of solids will exhibit a certain viscosity as it flows through the duct means, and with constant viscosity the underflow will remain at a fixed rate. As the solids content increases, the resulting increased viscosity of the underflow causes it to flow at a reduced rate through the duct means, thus reducing the amount of underflow recycled through the centrifuge and counteracting the increase in viscosity. In this way, the prior art device holds the concentration of solids in the underflow substantially constant.

This prior art remedy addressed a constant underflow concentration, whereas the underflow control apparatus embodying the present invention achieves an optimal control for a disk nozzle centrifuge. This optimal underflow control mechanism adjusts the volume of the recycle flow and thereby the underflow for different feed and underflow concentration situations.

Another prior art system for controlling the underflow from nozzle centrifuges is disclosed in U.S. Pat. No. 4,162,760, issued to Hill in 1979. The manual system uses an adjustable head sump for recycling with an adjustable toroidal ring-type valve. The device is not viscosity or flow sensitive nor does it attempt to create or maintain an optimal solids concentration in the overflow due to alteration in feed volumes and underflow solids concentrations.

Real processes have feed concentrations that constantly vary and, consequently, the optimal underflow operating point will vary with each change. Process control is needed to maintain the optimal underflow concentration. The prior art devices, including the two previously identified, are not able to control the centrifuge in the optimal sense. The two general types of disk-nozzle process controls identified are the manual valve (non-automatic) and constant underflow control. These two concepts are depicted in FIG. 1. In the manual control situation, the recycle stream is set to a certain rate by manually setting a hand valve. By fixing the recycle rate, any feed solids change will change the underflow solids concentration. This is depicted by line N-N' in FIG. 1. If one initially sets the valve at U2 which is the optimal point for feed F2, then any change in the feed solids will draw the operation away from optimality. The logical consequence of no control is that the overflow will at some point in the operation, exceed the specification limit for solids. Operators, as a result thereof, have chosen to operate (with no control) at $U_B$, as shown in FIG. 1. This point is not optimal for feed F2 but it creates a buffer so that the overflow will always meet the desired product specification.

Constant underflow control is shown as line C-C' in FIG. 1. The control scheme is better than no control at all but is still far short of optimal. The method can be enhanced if combined with the aforementioned buffer concept. As discussed above, Lee et al (4,505,697) is an example of such a device. The device does not reach its desired constant underflow control target. Its poor control characteristics are shown in FIG. 2 as "Viscosity Induced Underflow Control."

It is an object of the present invention to obtain a constant overflow solids concentration through use of an optimal underflow control system for disk nozzle centrifuges which efficiently alters underflow solids concentration for different feed conditions.

SUMMARY OF THE INVENTION

The optimal control scheme for a disk nozzle centrifuge is shown in FIG. 2. For feed concentration F2 there is a corresponding optimal underflow concentration, U2, that will meet the overflow solids specifications. Higher feed concentration such as F3, requires a lower underflow concentration, U3 for optimality. Likewise, feed reductions such as Fl requires a change in underflow to Ul. For all feed concentrations, there is a unique underflow concentration that will achieve optimum processing. These optimal points are depicted as a straight line with slope -m in FIG. 2. In practice, the underflow/feed relation may be non-linear but it will have the general shape as the line shown in FIG. 2.

The optimal underflow control for a disk nozzle centrifuge covers variable feed flow rate operation as well. In this situation, optimal control will still have the negative slope line as depicted in FIG. 2 although the actual value of -m is slightly different from the variable feed solids situation.

The optimal underflow control device accomplishes the above by insertion of a control module and sensing chamber in the withdraw line of the underflow to sense changes in the underflow suspended solids content. These changes are detected by changes in the liquid level in the sensing chamber through use of a pressure or level sensor. The detected changes signal a level indicator control which then alters the flow volume in the recycle line of the underflow. The flow volume is adjusted by use of a highly responsive valve in the line. Any control module design which can maintain the setpoint value in the sensing chamber to control optimal centrifuge performance could be utilized.

In the preferred practice of the invention, pneumatic valve means are provided for adjusting the flow rate in the underflow recycle line. In this way, the solids concentration at which the underflow is held is maintained at an optimum level to prevent solids from migrating over into the overflow and causing poor liquid effluent production.

The optimal underflow control means includes a sensing chamber and flow interference means that causes a liquid level backup to be created in the sensing chamber. In addition, there is provided a level sensor which monitors the liquid level backup in the chamber and a level indicator control to sense changes in the level and send signals as a result thereof. The signals open or close a valve in the recycle line to control the flow therethrough thereby readjusting and restoring the desired solids concentration in the underflow withdraw stream. Such an alteration will control the solids content in the overflow. In addition, a set level baffle is used between the sensing chamber and flow interference means to create a desirable and measurable liquid level for measurement.

BRIEF DESCRIPTION OF THE DRAWINGS In the drawings,

FIG. 3 is a vertical sectional view of a disk nozzle centrifuge illustrating process streams entering and leaving the centrifuge;

FIG. 4 is a general layout of the underflow control apparatus;

DETAILED DESCRIPTION OF THE PREFERRED EMBODIMENT

Figure 1:
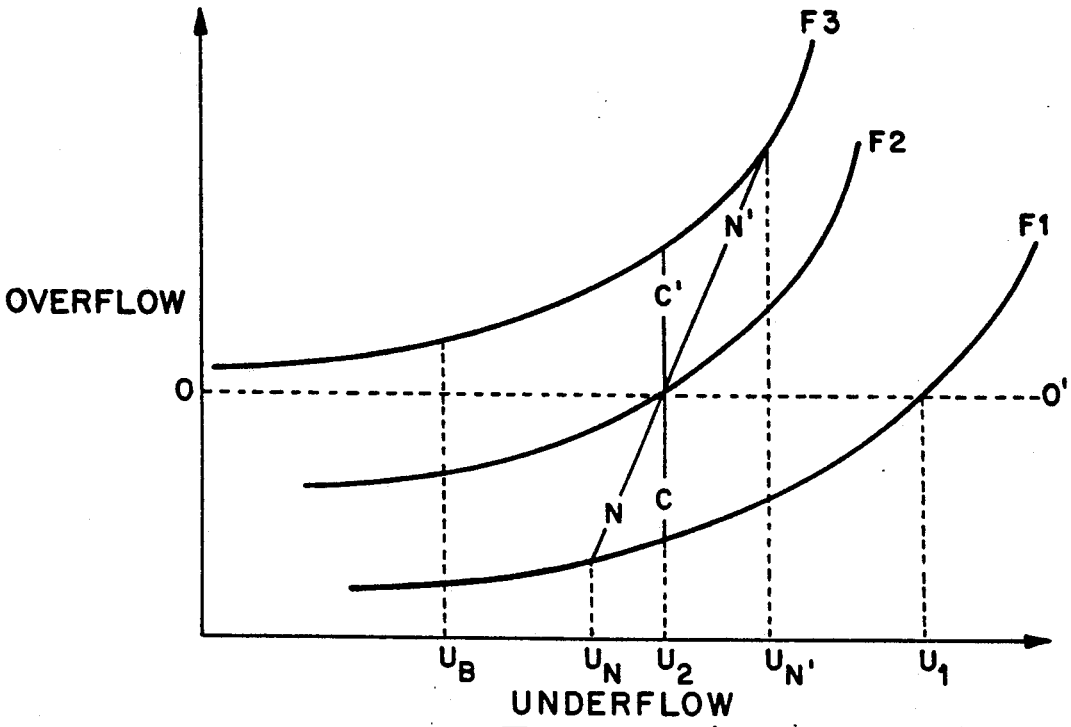
FIG. 1 (Prior Art)
FIG. 1 is a graph showing two prior art underflow control schemes for disk nozzle centrifuges.

Referring now to the drawings, and more particularly to FIG. 3, the process streams of a disk nozzle centrifuge are depicted. Disk nozzle centrifuges separate the feed stream 20 into a liquid overflow stream 22 that is mostly liquid and an underflow stream 24 that contains the majority of solids that enter with the feed. Solids exit the periphery of the bowl through nozzles 26, 28 in the underflow stream 24 and underflow discharge rate is immutable to all process changes that are involved in centrifuge process control. A portion of the nozzle discharge is recycled back (recycle 30) into the centrifuge bowl to effect control on the underflow suspended solids. A wash stream 32 is used, when desired, to reduce mother liquor that leaves with the withdraw stream 34 by diluting soluble solids concentration of the recycle stream 30.

FIG. 4 describes the general layout of the preferred embodiment of the invention. The optimal underflow control system 30 includes a sensing chamber 40, a set level baffle 41, a control module 42, a draw-off valve 44, a recycle valve 46, as well as a pressure indicator 48. Also depicted are the disk nozzle centrifuge 50, feed line 52, overflow 54, withdraw line 56, recycle line 58. The level sensor 60 and level indicator control 62 are also depicted. The overflow liquid effluent 54 and the underflow withdraw line 56 under normal optimal desired flow conditions have a desired concentration of solids. As the withdraw 56 flows into the control module 42 a set amount of liquid backs up into the sensing chamber 40 and is measured by level sensor 60. The set level can be changed by adjustment of the set level baffle 41 to make changes in the level easier to measure. When the feed rate or underflow suspended solids content varies the level of the backup in the sensing chamber 40 will be changed. This change will be detected by the level sensor 60 and the level indicator control 62 will then act to open or close the recycle valve 46 in response thereto. This optimal control scheme will allow adjustment to take place and maintain desired underflow suspended solids content to be achieved, thereby controlling the solids concentration in the overflow.

Figure 5:
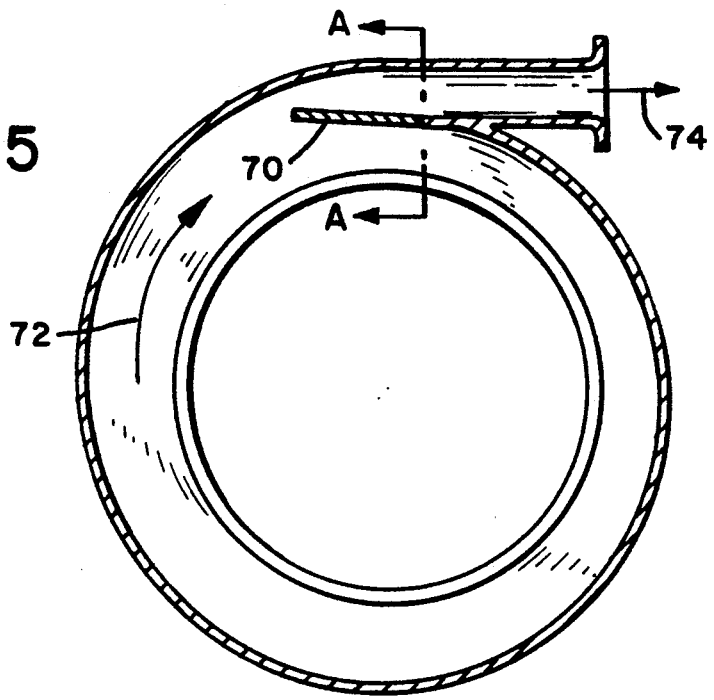
FIG. 5 is a cross sectional view of the centrifuge bowl with volute adaptor plates.

FIG. 5 illustrates a volute adaptor plate 70 which can be placed in the underflow stream 72, in the bowl of the centrifuge (flow direction depicted by arrow). Illustrated is the flow prior to its exit or discharge and the location of the volute adaptor plate 70. As the stream 72 exits the centrifuge, air can be entrained therein in large quantities causing problems. The volute adaptor plate 70 creates a seal such that the amount of entrained air is minimized.

Figure 6:
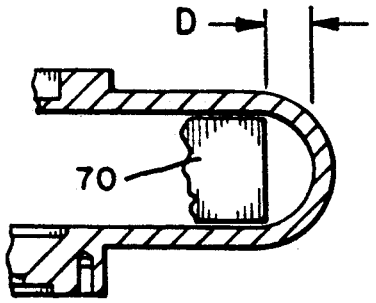
FIG. 6 is a section along the lines A—A of FIG. 5.

FIG. 6 is a section taken along the line A—A of FIG. 5. The volute adapter plate 80 is shown with a dimension "D" which is adjusted based upon the process to prevent undesirable air entrainment in the flow.

Figure 7:
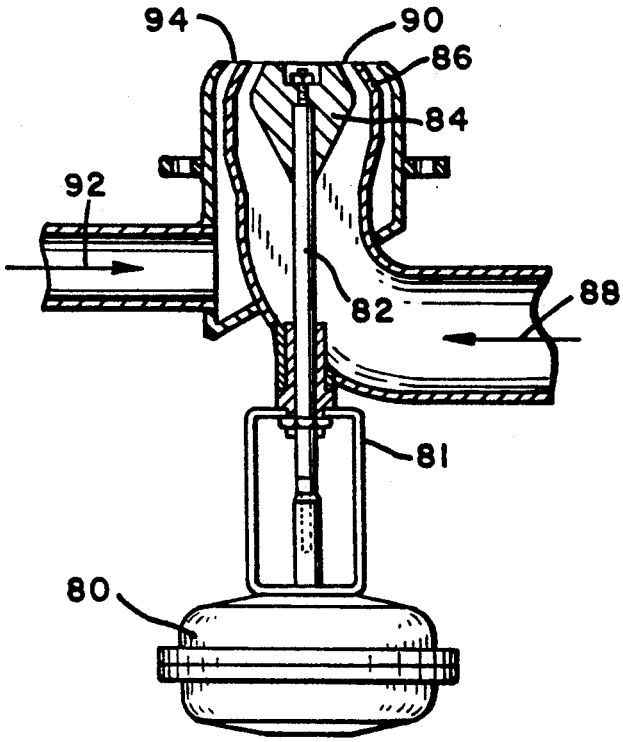
FIG. 7 is a fragmentary enlarged sectional view of the recycle stream and recycle valve.

FIG. 7 is a detailed depiction of the recycle valve including its pneumatic actuator 80, valve stem 82, valve plug 84, and valve seat 86. Additionally, the recycle stream entrance 88, recycle exits 90, wash stream entrance 92 and wash stream exit 94 are depicted. The recycle valve 81 acts in accordance with the level indicating control instructions to restrict the recycle flow and thereby alter the underflow discharge.

Figure 8:
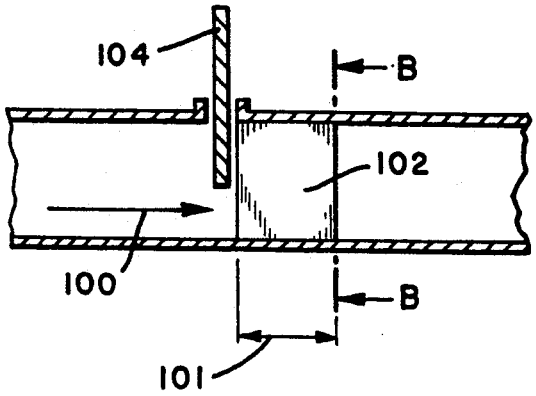
FIG. 8 is a sectional view of the withdraw stream and control module.
Figure 9:
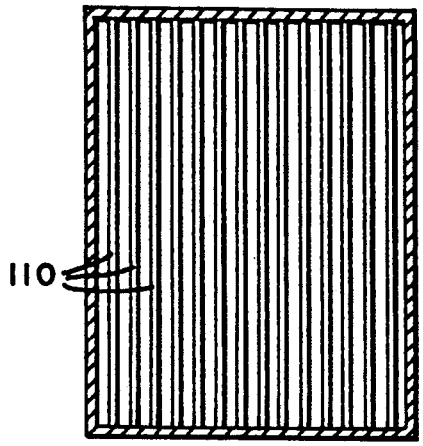
FIG. 9 is a view of the flow interference device along the line B—B.

The withdraw stream 100 passes through a control module 102 (FIG. 8) which is a set of closely spaced plates situated within the withdraw pipeline. The plates 110 are aligned parallel within the withdraw line (see FIG. 9). The control module length 101 is dependent upon centrifuge and process conditions. Hydraulic pressure, upstream of the control module is the manifestation of the interference. A sensing chamber (not shown) is placed immediately upstream the module which allows a liquid level to accumulate in response to the pressure. Measurement of this liquid level is achieved through pressure sensing elements. Piping downstream of the control module is non-restrictive so that the sensing chamber liquid level will be a reliable measure of the pressure drop across the module. A level set baffle 104 (FIG. 8) which is placed between the control module and the sensing chamber is used to set a measurable level in the sensing chamber so that all liquid level changes in the chamber can be detected.

Sensing chamber liquid level can change for two reasons: (1) A change in underflow suspended solids content: on increase in suspended solids content leads to higher stream viscosity which will necessitate higher pressure drop to maintain the same flow through the module. The opposite effect is true if underflow solids content decreases; (2) A change in withdraw flow rate (at constant underflow solids): higher flow requires higher level and lower flow requires lower level.

Figure 10:
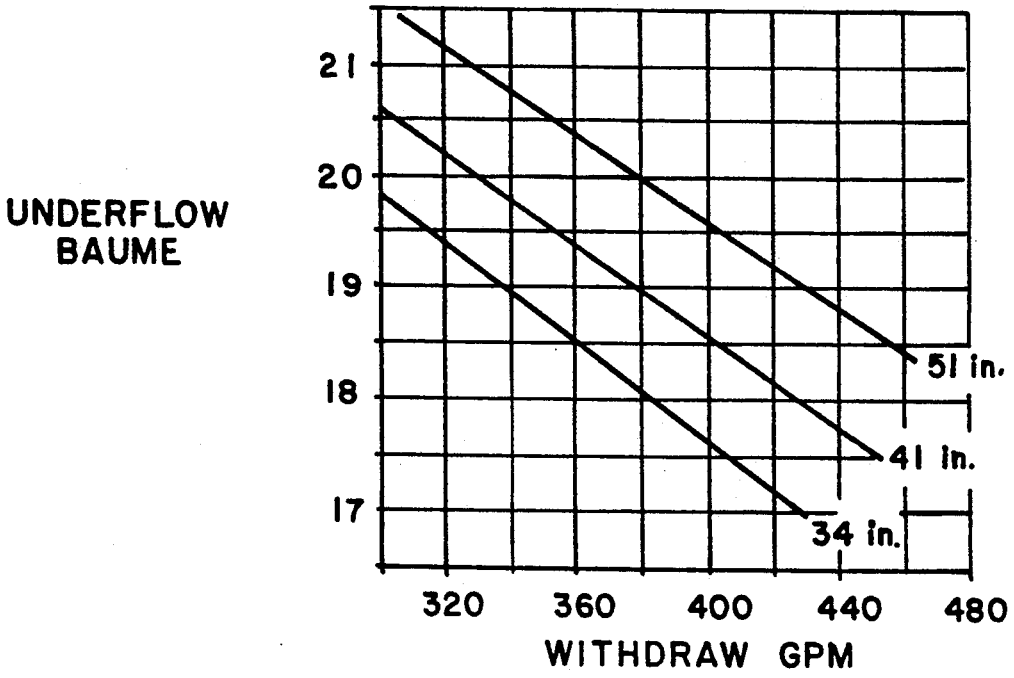
FIG. 10 is a graphical representation of the underflow control sensing chamber liquid levels for the example.

Both effects (1) and (2) above are depicted into one graph which is shown in FIG. 10. The data is arranged so that constant sensing chamber liquid level lines are depicted. Corn starch suspended in water was the fluid used to generate this plot. Fluid density, measured as degrees Baume (Bé) is the means by which suspended solids is measured for this material.

Figure 12:
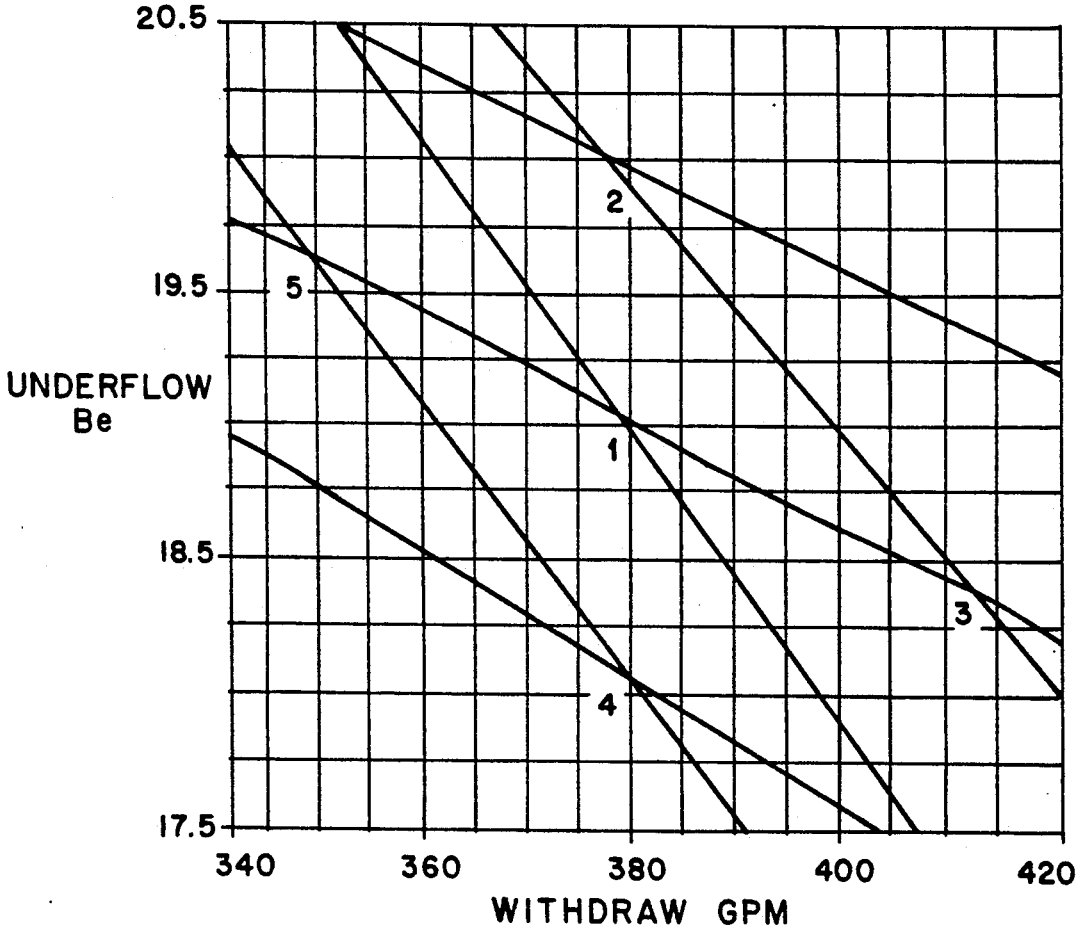
FIG. 12 is a graphical representation of the feedback control mechanism for the centrifuge.
Figure 11:
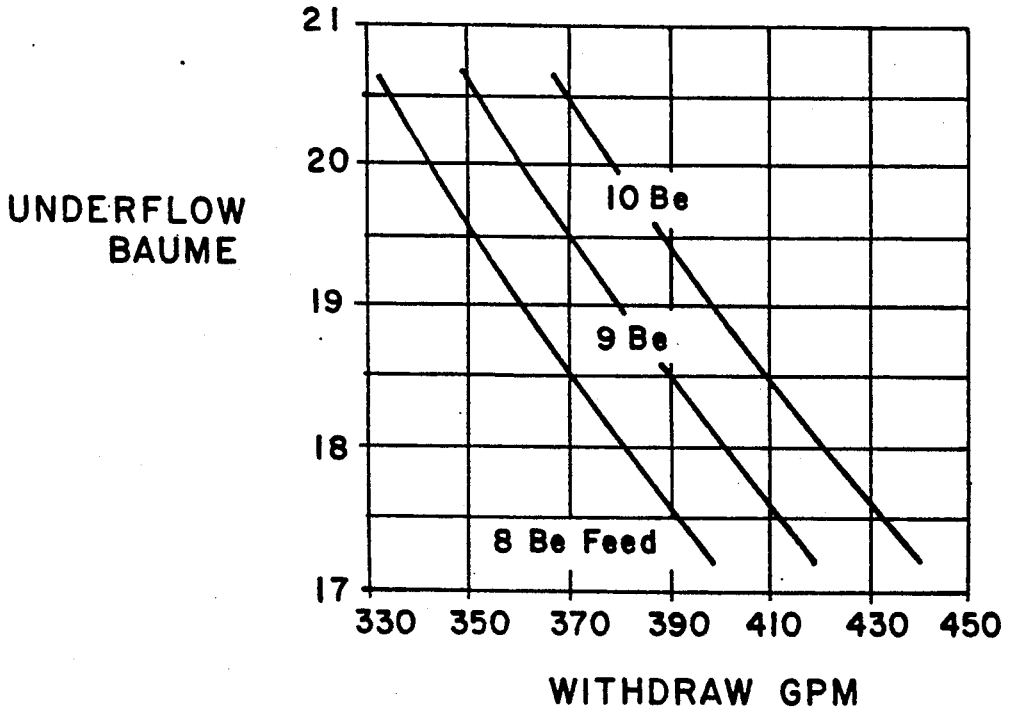
FIG. 11 is a graphical representation of the operating lines for stack separation in a high capacity centrifuge.

Shown in FIG. 11 are the operating lines for starch separation in a high capacity disk nozzle centrifuge. Solids which enter with the feed find their way to exit at the withdraw stream. Additionally, solids enter a predetermined flow rate with the feed and, consequently, they exit the centrifuge at the same flow rate in the withdraw stream. The relationship between the withdraw flow rate and the withdraw solids content is such that the product of both is a constant. For a stable operation, one can adjust the withdraw flow rate, and the withdraw solids concentration, of its own accord, will adjust to maintain a constant mass balance of solids leaving the centrifuge. This relationship is depicted for varying withdraw flow rates by the operating lines in FIG. 11. Again, degrees Baume are used to measure suspended solids content of the process streams. Both plots of FIGS. 10 and 11 are merged to achieve FIG. 12 which describes the control scheme of this invention. In our example, the initial feed to the centrifuge is 9 Bé (at 800 gpm) with the underflow adjusted to 19 Bé. From the operating line, the withdraw is 380 gpm (shown as point 1). The sensing chamber registers a liquid level of 41 inches If the feed were to change to 10 Bé, a new operating line is imposed on the centrifuge. The underflow Be and withdraw rate must adjust themselves to accommodate the new conditions. If withdraw flow rate is held constant (no underflow control), the underflow will rise to 20 Bé. Simultaneously, the liquid level will rise to 51 inches (point 2 FIG. 12). Likewise, the underflow will drop to 18.1 Bé and the liquid level will drop to 34 inches (shown as point 4, FIG. 12) if the feed were to drop to 8 Bé—again a new operating line.

The controller is directed to maintain the liquid level by increasing the withdraw (reducing the recycle) rate if the level goes above the setpoint and to decrease the withdraw rate if the level decreases below the setpoint. Control mechanism is conventional feedback control having proportional plus reset feedback control action. The setpoint liquid level is determined during startup by adjusting the level set baffle. In our example, the setpoint is 41 inches.

If liquid level were to rise above the setpoint (in our example, caused by a feed change from 9 Bé to 10 Bé), the controller action will signal an increase in withdraw to reduce the level. Without knowledge of the operating lines, one can get confused at this time as increasing withdraw will initially increase the level and one wonders if the control scheme is working backwards. But any controller induced mis-direction is quickly overwhelmed by the decrease in underflow solids which leads to a reduction in liquid level. Controller action will continue until the initial level (41 inches) is re-established. This will be point 3 which has a lower underflow solids concentration than the initial conditions and will be located on the 10 Bé operating line. A similar pathway can be traced for a decrease in feed solids: A change in feed from 9 to 8 Bé yields a new operating point 5 in which the underflow has higher suspended solids as compared to the initial conditions.

Figure 2:
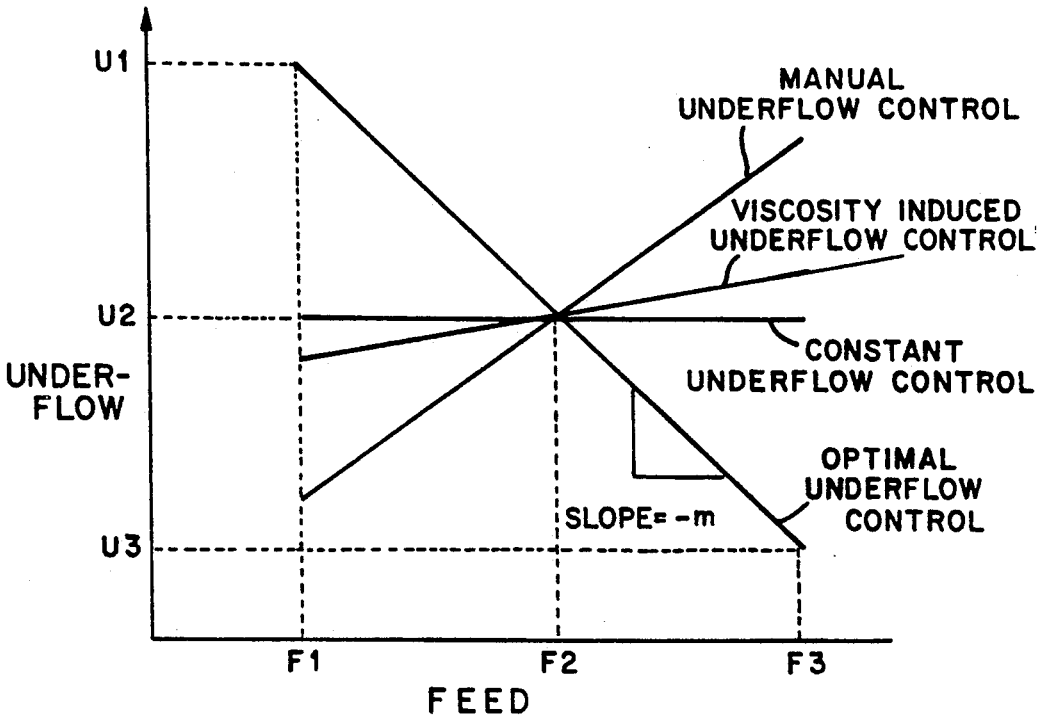
FIG. 2 is a graphical display of optimal underflow centrifuge control.
Figure 13:
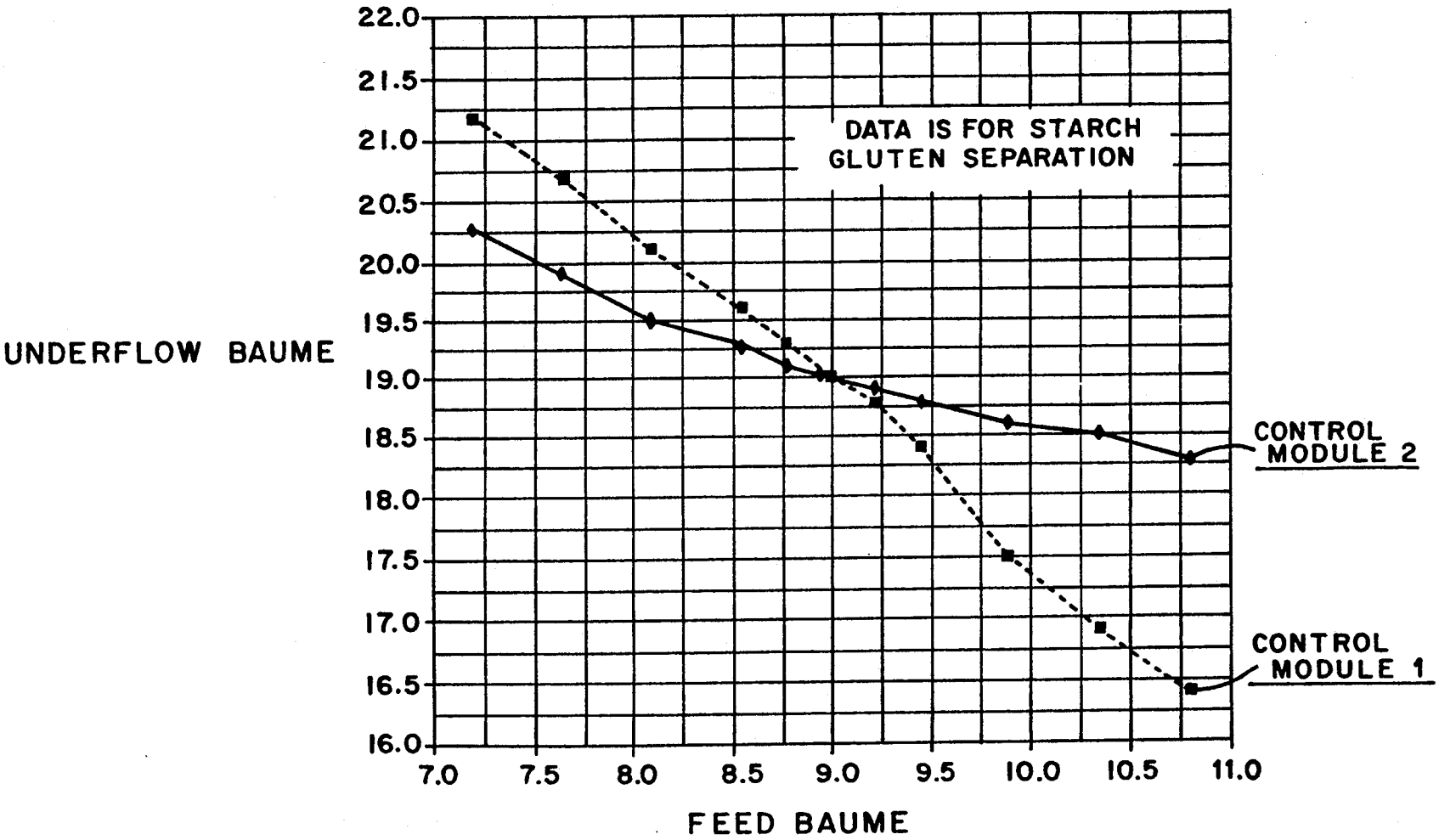
FIG. 13 is a graphical representation for two underflow control modules.

In our example, we define the response of the control system as the resultant underflow Bé as a function of feed Be. This is shown in FIG. 13 as Control Module 1. For this response line to be optimal as per the concepts of FIG. 2, it must have a slope (-m) that is the same as the optimal control line. In practice, the optimal control line is determined from field data so a means is needed to alter the slope of the response line. The response for "Control Module 2" in FIG. 13 depicts one such method. The difference in the two Control Modules is in plate length (see FIGS. 8 and 9): module 2 has the same number of plates, but the plate length is twice that of Control Module 1.

It must be noted that closely spaced plates is not only means by which the interference can be created. This interference can be achieved by other devices such as concentric tubes, static in-line mixers, or simply a long narrow-diameter pipe. Virtually any hydraulic resistance method can be used provided that the interference-liquid level-operating line relationship results in a control response line that is coincident with the optimal control line.

A secondary preferred embodiment is one in which the liquid level in the sensing chamber is allowed to rise and fall in response to the changes in the withdraw stream. A proportional only controller is used to maintain the level setpoint. Such a controller will vary its output signal in proportion to the error (difference between the actual liquid level and the setpoint). Equilibrium can be achieved even though setpoint is not achieved.

Although one embodiment of the present invention has been disclosed in detail, it is expressly understood that the invention is not limited thereto. Various changes can be made in the design and arrangement of parts without departing from the sport and scope thereof as the same will now be understood by those skilled in the art.

What is claimed is:

1. An apparatus for controlling the amount of underflow recycled in a disk-nozzle type centrifugal separator so as to control the level of solids in a liquid effluent overflow of the separator, comprising:

a chamber having an inlet and an outlet, said inlet of said chamber being fluidly connected to a withdraw line of the separator;

a flow interference means fluidly connected to the outlet of said chamber so as to produce an accumulation of underflow within said chamber wherein a variation in the underflow suspended solids content varies the level of the underflow accumulated within said chamber;

a level indicating means for indicating the level of the underflow in said chamber, said level indicating means outputting a control signal representative of the level of the underflow in said chamber;

a recycle conduit having a first and second opening, said first opening being fluidly connected to the withdraw line for receiving the underflow; and a valve means having an inlet and an outlet, said inlet of said valve means being fluidly connected to said second opening of said recycle conduit, said outlet of said valve means being fluidly connected to a centrifuge bowl of the disknozzle type centrifuge separator, said valve means being responsive to said control signal outputted by said level indicating means so as to regulate the amount of underflow in said recycle conduit that is returned to the centrifuge bowl thereby adjusting the level of solids in the liquid effluent overflow.

2. The apparatus of claim 1 further including a baffle intermediate said chamber and said flow interference means, said baffle being fluidly operative with and positioned at said outlet of said chamber for setting a measurable underflow level in said camber so that any underflow level changes in said chamber are within a predetermined sensing range of said level indicating means.

3. The apparatus of claim 2 wherein said level indicating means comprises:

a first sensor means for indicating the level of the underflow in said chamber; and a second sensor means for outputting said control signal in response to the level of underflow indicated by said first sensor means.

4. The apparatus of claim 1 wherein said flow interference means comprises a plurality of closely spaced plates substantially parallel to the flow of the underflow, said plates interfering with the flow of the underflow so as to produce an accumulation of underflow within said chamber.

5. The apparatus of claim 1 further including a pressure indicator fluidly operative with said recycle conduit for indicating the pressure of the underflow flowing through said recycle conduit.

6. The apparatus of claim 1 wherein said valve means includes a pneumatic actuator responsive to said control signal.

7. The apparatus of claim 6 wherein said control signal has a varying magnitude wherein the amount of underflow in said chamber is represented by a corresponding magnitude of said control signal said corresponding magnitude determining the degree to which said valve means opens or closes.

8. The apparatus of claim 2 wherein when the amount of underflow in said chamber exceeds the level set by said baffle, the amount of underflow returned to the centrifuge bowl of the separator by said recycle conduit is decreased thereby increasing the rate of withdrawal of underflow through the withdraw line of the separator and reducing the level of underflow in said chamber to the level set by said baffle.

9. The apparatus of claim 8 wherein the level of underflow in said chamber increases above the level set by said baffle when the underflow suspended solids content increases.

10. The apparatus of claim 9 wherein when the level of underflow in said chamber is below the level st by said baffle, the amount of underflow returned to the centrifuge bowl of the separator by said recycle conduit is increased thereby decreasing the rate of withdrawal of underflow through the withdraw line of the separator and increasing the level of underflow in said chamber to the level set by said baffle.

11. The apparatus of claim 10 wherein the level of underflow in said chamber decreases below the level set by said baffle when the underflow suspended solids content decreases.

12. The apparatus of claim 1 further including a volute adapter plate positioned at the outlet of the centrifuge bowl of the centrifugal separator so as to limit the amount of entrained air contained in the underflow.

13. A method of operating a disk-nozzle type centrifugal separator so as to control the level of solids in the liquid effluent overflow, comprising the steps of:

(a) providing an apparatus for controlling the amount of underflow recycled in a disk-nozzle type centrifugal separator, said apparatus comprising a chamber having an inlet and an outlet, said inlet of said chamber being fluidly connected to a withdraw line of the separator, a flow interference means fluidly connected to the outlet of said chamber so as to produce an accumulation of underflow within said chamber wherein a variation in the underflow suspended solids content varies the level of the underflow accumulated within said chamber, a level indicating means for indicating the level of the underflow in said chamber, said level indicating means outputting a control signal representative of the level of underflow in said chamber, a recycle conduit having a first and second opening, said first being fluidly connected to the withdraw line for receiving the underflow, and a valve means having an inlet and an outlet, said inlet of said valve means being fluidly connected to said second opening of said recycle conduit, said outlet of said valve means being fluidly connected to a centrifuge bowl of the disk-nozzle type centrifuge separator, said valve means being responsive to said control signal outputted by said level indicating means;

(b) flowing the underflow of the withdraw line into said chamber;

(c) interfering with the flow of underflow at the outlet of said chamber so as to produce an accumulation of underflow in said chamber;

(d) indicating the level of the underflow in said chamber;

(e) producing a control signal representative of the level of underflow in said chamber indicated in step (d); and (f) adjusting said valve means in response to said control signal so as to regulate the amount of underflow in said recycle conduit that is returned to the centrifuge bowl of the separator thereby regulating the level of solids in the liquid effluent overflow.

14. The method of claim 13 further including a baffle intermediate said chamber and said flow interference means, said baffle being fluidly operative with and positioned at said outlet of said chamber for setting a measurable underflow level in said chamber so that any underflow level changes in said chamber are within a predetermined sensing range of said level indicating means.

15. The method of claim 14 wherein said level indicating means comprises:

a first sensor means for indicating the level of said underflow in said chamber; and a second sensor means for outputting said control signal in response to the level of underflow indicated by said first sensor means.

16. The method of claim 14 wherein said flow interference means comprises a plurality of closely spaced plates substantially parallel to the flow of the underflow, said plates interfering with the flow of the underflow so as to produce an accumulation of underflow within said chamber.

17. The method of claim 13 further including a pressure indicator fluidly operative with said recycle conduit for indicating the pressure of the underflow flowing through said recycle conduit.

18. The method of claim 13 wherein said valve means includes a pneumatic actuator responsive to said control signal.

19. The method of claim 18 wherein said control signal has a varying magnitude wherein the amount of underflow in said chamber is represented by a corresponding magnitude of said control signal, said corresponding magnitude determining the degree to which said valve mans opens or closes.

20. The method of claim 19 wherein when the amount of underflow in said chamber exceeds the level set by said baffle, the amount of underflow returned to the centrifuge bowl of the separator by said recycle conduit is decreased thereby increasing the rate of withdrawal of underflow through the withdraw line of the separator and reducing the level of underflow in said chamber to the level set by said baffle.

21. The method of claim 20 wherein the level of underflow in said chamber increases above the level set by said baffle when the underflow suspended solids content increases.

22. The method of claim 21 wherein when the level of underflow in said chamber is below the level set by said baffle, the amount of underflow returned to the centrifuge bowl of the separator by said recycle conduit is increased thereby decreasing the rate of withdrawal of underflow through the withdraw line of the separator and increasing the level of underflow in said chamber to the level set by said baffle.

23. The method of claim 22 wherein the level of underflow in said chamber decreases below the level set by said baffle when the underflow suspended solids content decreases.

24. The method of claim 13 further including a volute adapter plate positioned at the outlet of the centrifuge bowl of the centrifugal separator so as to limit the amount of entrained air contained in the underflow.

* * * * *

UNITED STATES PATENT AND TRADEMARK OFFICE

CERTIFICATE OF CORRECTION

PATENT NO. : 5,300,014

DATED : April 5, 1994

INVENTOR(S) : Chin et al.

It is certified that error appears in the above-identified patent and that said Letters Patent is hereby corrected as shown below:

Column, 7, Line 66, Claim 10: please delete "st" and insert - - set - - .

Signed and Sealed this

Second Day of August, 1994

Bruce Lehman

*Attest:*

BRUCE LEHMAN

*Attesting Officer*

*Commissioner of Patents and Trademarks*